United States Patent [19]

Schweinsberg

[11] 4,085,535

[45] Apr. 25, 1978

[54] DATA CARRIER HOLDER

[75] Inventor: Dieter Klaus-Jürgen Schweinsberg, Lautertal-Unterlauter, Germany

[73] Assignee: Eichner Organisation KG, Coburg, Germany

[21] Appl. No.: 687,596

[22] Filed: May 18, 1976

[30] Foreign Application Priority Data

Feb. 2, 1976 Germany ..... 2603794

[51] Int. Cl.[2] ..... G09F 1/10

[52] U.S. Cl. ..... 40/124.2

[58] Field of Search ..... 40/104.19, 104.18, 124, 40/124.2, 359

[56] References Cited

U.S. PATENT DOCUMENTS

| | | | |
|---|---|---|---|
| 1,294,948 | 2/1919 | Rand | 40/23 A X |
| 1,536,263 | 5/1925 | Orzchovski | 40/124.2 |
| 2,544,844 | 3/1951 | Liber | 40/159 X |
| 2,805,502 | 9/1957 | Smith et al. | 40/104.19 X |
| 3,071,881 | 1/1963 | Rutterbusch | 40/159 X |
| 3,959,904 | 6/1956 | Holliday | 40/124.2 X |

*Primary Examiner*—Louis G. Mancene
*Assistant Examiner*—Wenceslao J. Contreras
*Attorney, Agent, or Firm*—Watson, Cole, Grindle & Watson

[57] ABSTRACT

A data carrier holder having a plurality of overlapping compartments. A transparent pocket is positioned in front of each data carrier compartment. The transparent pocket is provided for receiving strips with information identifying the contents of the data carrier in the associated data carrier compartment.

2 Claims, 4 Drawing Figures

DATA CARRIER HOLDER

BACKGROUND OF THE INVENTION

The present invention relates to a holder having a plurality of overlapping slip-in compartments for data carriers such as film sheets, microfiches and magnetic cards.

Such data carrier holders are well known. The holders are generally made of plastic and have a plurality of overlapping compartments, each of which normally receives a single carrier. These known holders, however, usually do not have any excess space that can be written upon and thus it is difficult to provide sufficiently detailed identifying information concerning the contents of the slipped-in data carriers. Likewise, the data carriers themselves do not have any space on which identifying information can be provided.

SUMMARY OF THE INVENTION

An object of the present invention is to provide data carrier holers which do not have the above-mentioned deficiencies.

This objective is achieved in accordance with the present invention by providing in front of each slip-in compartment a transparent initial compartment for receiving an identification strip.

The separate identification strips offer the possibility of carrying sufficient notations concerning the data carriers which are slipped into the compartment behind the strip. Furthermore, the identification strip can be easily exchanged with a different strip when the data carrier is replaced by another one. When the binder in which the holders are mounted is fully opened, the identification strips are fully visible.

Each of the overlapping members are formed from a piece of material which is folded in a V-shape. Each of the V-shaped pieces of material is placed in a separate V-shaped cover which is made of a transparent material. The V-shaped units are then inserted into each other so as to form the data carrier holder. The spaces between the associated transparent covers and V-shaped members form the initial compartments into which identifying notations can be inserted.

In general, all of the members utilized in forming the data carrier holder are made of a plastic material.

DESCRIPTION OF THE PREFERRED EMBODIMENT

Figure 1:
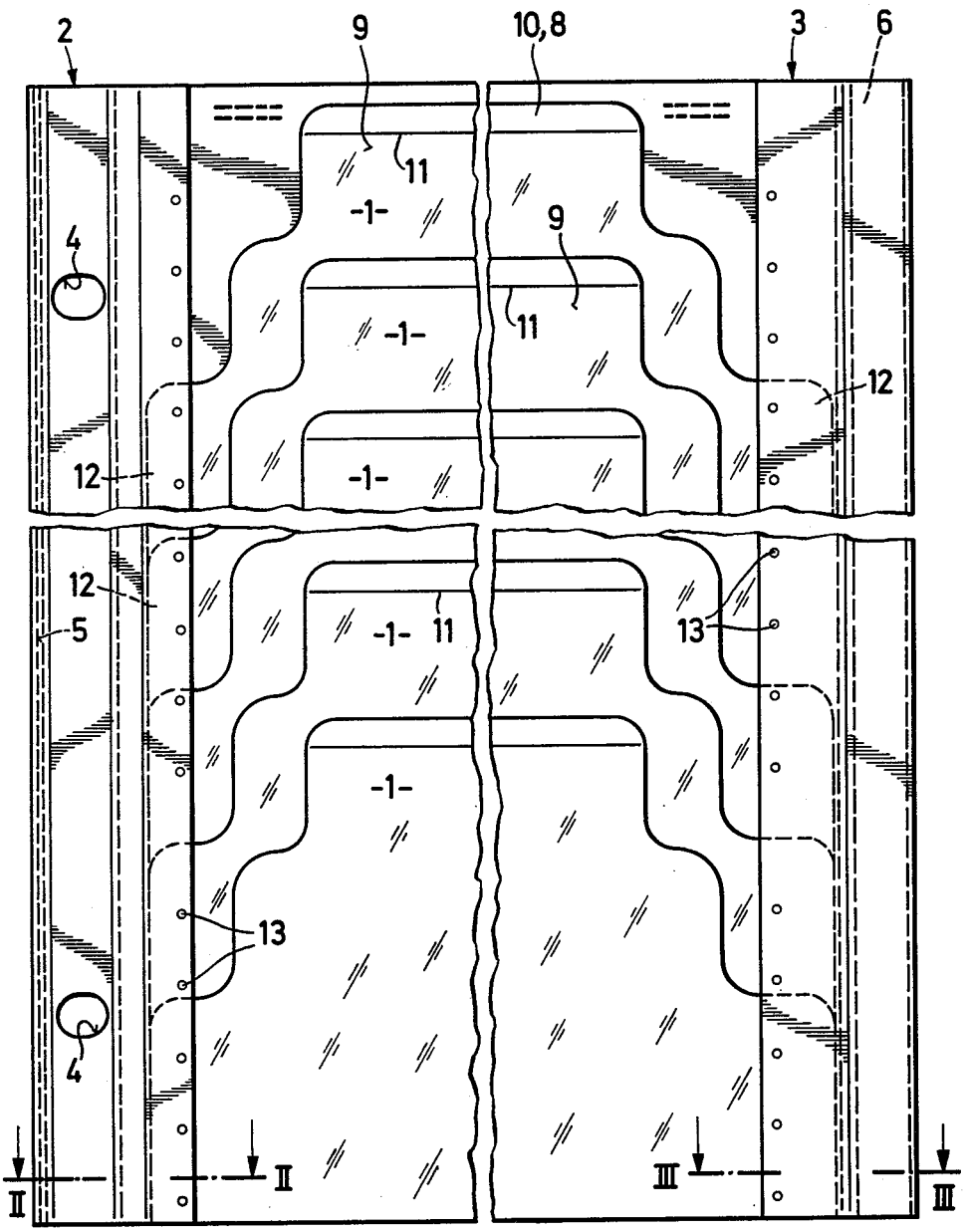
FIG. 1 is a front elevational view of a data carrier holder in accordance with the present invention.

As shown in FIG. 1, a plurality of overlapping members 1 are secured together to form the compartments of a data carrier holder. The overlapping members are held together by lateral securing, or clamping, members 2 and 3 which are attached to laterally projecting flaps of members 1.

Figure 2:
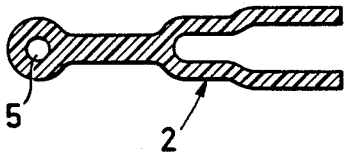
FIG. 2 is a sectional view along lines II—II of FIG. 1 showing one of the lateral securing members which holds the overlapping members together.

The holders can be constructed so that they can be mounted in a ring binder. If the holders are to be so mounted then they are provided with punch holes 4. In case the holders are to be mounted in a swinging structure, one lateral edge of the holder can be provided with a hole 5, as shown in FIG. 2.

Figure 3:
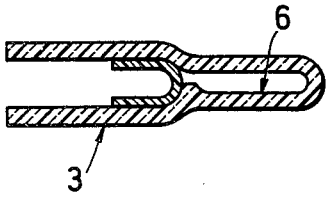
FIG. 3 is a sectional view along lines III—III of FIG. 1 of the other lateral securing member.

A hollow profile edge 6 is provided at the free front edge of the holder, as shown in FIG. 3. A strip containing additional identifying information can be slipped into hollow profile edge 6. This hollow profile edge, however, need not be provided and can be eliminated.

Figure 4:
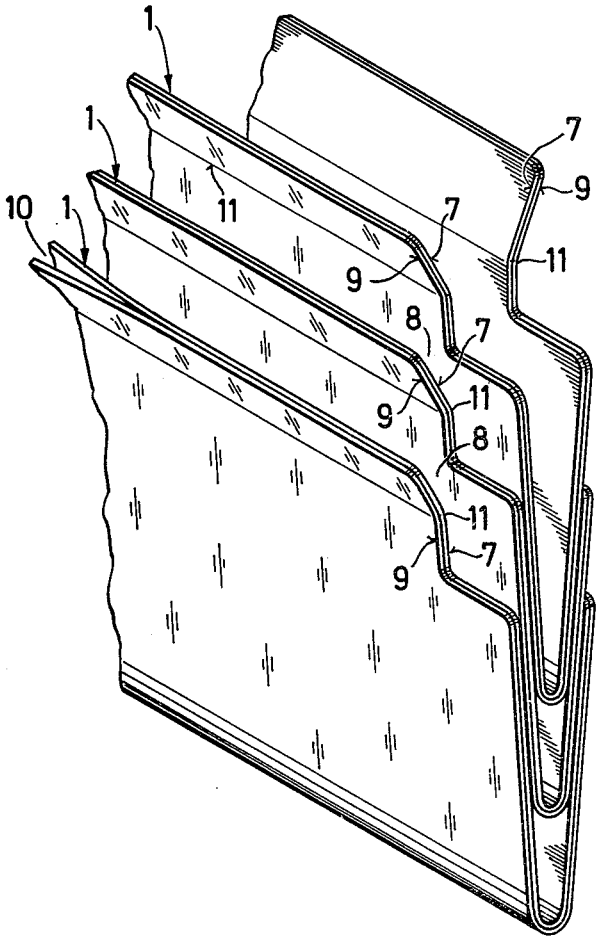
FIG. 4 is a sectional perspective view of the overlapping V-shaped members of the holder in accordance with the present invention.

Overlapping members 1 are formed by pieces of material 7 folded in the shape of a V, as shown in FIG. 4. These V-shaped members 7 when arranged in an overlapping arrangement form slip-in compartments 8 for receiving the data carriers. Each V-shaped member 7 is enclosed by a transparent cover 9, which is also folded in a V-shape and thereby forms an outer pocket. Outer, or initial, pocket 10 can receive a strip on which sufficient information can be put concerning the contents of the data carrier slip-in behind it.

The upper portion of both associated V-shaped members 7 and 9 are provided with a horizontal fold 11. Fold 11 makes it difficult to remove the information strip from the outer pocket. In this manner, the strip is secured against falling out of the pocket. In contrast, however, the data carrier, e.g. a magnetic card, which is frequently used can be easily removed and reinserted since fold 11 provides an opening for easy access into compartment 8. When reinserting the data carrier, it is also guaranteed that it will slide into compartment 8 which is provided for this purpose and never into pocket 10 which is provided for the information strip.

In this way, when the binder is opened up, sufficient information can immediately be gained as to the contents of the data carriers slipped into each compartment thereby considerably facilitating the search for the desired carrier and helping to eliminate the removal of the wrong data carrier.

It is noted that the above description and the accompanying drawings are provided merely to present an exemplary embodiment of the present invention and that additional modifications of such embodiment are possible within the scope of this invention without deviating from the spirit thereof.

1. A data carrier holder which comprises:

a plurality of overlapping, generally V-shaped slip-in data carrier means inserted within each other, each of said data carrier means providing a compartment for receiving data carriers;

generally V-shaped transparent means positioned to cover the outer surfaces of each of said data carrier means and able to form a pocket therebetween, said pocket formed between each said transparent means and each said data carrier means serving to receive strips with information identifying the contents of the compartment in the associated data carrier means, said information on said strips being visible through said transparent means.

2. A data carrier holder as defined in claim 1 wherein the upper edges of each of said generally V-shaped data carrier means with associated transparent cover means are folded outwardly along horizontal fold lines.

* * * * *